US005406039A

United States Patent [19]

Rerup et al.

[11] Patent Number: 5,406,039

[45] Date of Patent: Apr. 11, 1995

[54] SECTIONAL ACOUSTICAL BARRIER WALL SYSTEM

[75] Inventors: Hans J. Rerup, Mitchell; Martin E. Rohn, Stratford, both of Canada

[73] Assignee: Durisol Materials Limited, Mitchell, Canada

[21] Appl. No.: 131,382

[22] Filed: Oct. 5, 1993

[51] Int. Cl.[6] ..... E04B 1/82

[52] U.S. Cl. ..... 181/210; 404/6; 52/595; 181/294

[58] Field of Search ..... 52/583, 584, 587, 600, 52/601, 169.3, 169.4, 169.2, 566.03, 762, 764; 404/6; 181/210, 284–294; 405/285, 286, 287

[56] References Cited

U.S. PATENT DOCUMENTS 4,325,457 4/1982 Docherty et al. ..... 181/210

*Primary Examiner*—Ramon S. Britts
*Assistant Examiner*—Pamela A. O'Connor
*Attorney, Agent, or Firm*—Patrick J. Hofbauer

[57] ABSTRACT

An acoustical barrier wall system for use as an external wall acoustical attenuator for sound sources, is disclosed. The wall system comprises a plurality of acoustical barrier panels adapted for vertically stacked co-operating engagement. There are first and second attachment members each having a first end anchored within the main body portion of the acoustical barrier panels and an opposite threaded second end extending outwardly beyond the main body portion. There are first and second upright bracing members, each having a corresponding plurality of attachment member receiving means spaced therealong, the attachment member receiving means being adapted to receive the respective first and second attachment members therein. Connecting means in the form of co-operating nuts adapted to connect the attachment members and the attachment member receiving means in secured relation to one another. The plurality of vertically stacked acoustical barrier panels are secured together by the attachment members, the first and second upright bracing members, and the connecting means to thereby form a wall section for unitary placement between a pair of spaced upright frame members adapted to supportingly receive the plurality of acoustical barrier panels in vertically stacked cooperative engagement therebetween. The first and second upright bracing members are adapted for secure fastening to the respective one of the pair of spaced upright frame members following the unitary placement of the wall section.

31 Claims, 6 Drawing Sheets

50
70
51
70b
42
51
35
34
33
30
32
53
52
35
54
26
56
22
55
23
20

50
57
31
52b
51
51
53
"A"
"A"
"A"
52a
58
52
59
58
56

SECTIONAL ACOUSTICAL BARRIER WALL SYSTEM

FIELD OF THE INVENTION

This invention relates to acoustical barriers and more particularly to acoustical barrier wall systems for use at the side of roadways, most particularly on bridges, overpasses and the like.

BACKGROUND OF THE INVENTION

Many high-speed highways and other major roadways have reinforced concrete safety barriers positioned along their boundaries. These barriers are typically steel reinforced concrete barriers of about 40" in height, which are adapted to be joined one to the other in end-to-end relation so as to form a continuous barrier means with each safety barrier forming one section thereof. Such safety barriers are used most commonly along sections of highway or roadway where there is a high risk of vehicles crossing into an oncoming lane of traffic, or a high risk of vehicles veering off the highway and creating an unsafe situation for the passengers of the vehicle or for other parties. Barriers of this general type are commonly referred to in the trade as "Jersey" barriers, denoting the alleged first usage of this type of barrier in the state of New Jersey, U.S.A.

It has become increasingly common to erect such concrete safety barriers along the sides of bridges and overpasses so as to preclude, or at least lessen, the chance of a vehicle driving or otherwise falling over the side of the bridge or overpass, which can cause severe injury or death not only to the passengers in the vehicle, but also to other parties below the bridge or overpass. In this latter instance, the damage and danger to life from the secondary impact of the vehicle or portions of the concrete safety barrier hitting persons on the ground may be more serious than the original accident which caused the vehicle to leave the bridge or overpass.

Used in conjunction with the aforementioned safety barriers are cooperating acoustical barriers that are adapted to attenuate the sound level of roadway traffic noise as it is perceived from beyond the roadway. These acoustical barriers are typically situated on top of the cooperating safety barriers. In the event of an impact by a vehicle with the safety barriers, the cooperating acoustical barriers that are situated in conjunction therewith are also potentially subject to this impact, so that the same safety considerations apply to such acoustical barriers as to the concrete safety barriers, particularly when use in conjunction with a bridge or overpass.

One such type of acoustical barrier is disclosed in U.S. Pat. No. 4,325,457 to Docherty et al., which patent is incorporated herein by reference. This acoustical barrier system comprises a plurality of individual panels situated in stacked relation with respect to one another between a series of evenly spaced vertically disposed "H" beams, the "H" beams spaced apart at a distance just slightly greater than the width of the sound barrier panels. The acoustical barrier panels fit in interposed relation between adjacent "H" beams and are held in place by the flanges of these beams, in a specific manner as described in the patent. The acoustical barrier panels are substantially of the same width as the sections of the safety barriers atop which they sit. A single width of acoustical barrier panels stacked between two adjacent "H" beams is are hereinafter referred to as a "section".

These and similar acoustical barrier panels are typically put into place at the job site by lifting them using a crane or similar lifting apparatus, and then lowering each acoustical barrier panel into place, one on top of another. It is common to have about six to eight panels stacked one on top of another to form a section of acoustical barrier system of required height.

There are two distinct problematic areas associated with known prior art acoustical barrier panels of the general type described above. The first problem area centres around inefficiencies with the installation of prior art acoustical barrier panels. The installation of known acoustical barrier panels into place between adjacent "H" beam frame members is difficult, expensive and time consuming for several reasons. Firstly, the barrier panels, which are awkward to handle, must be put into place on top of each other one at a time. Moreover, erecting the acoustical barrier sections must be performed in an in situ setting, which is typically more dangerous, more time consuming and more costly than performing the same job in a factory type environment. Also, in situ construction is subject to postponement by reason of inclement weather conditions. Further, the rental of equipment, such as cranes and trucks to transport and handle prior art acoustical panels, may be prolonged, due to the lengthy construction time required to assemble prior art acoustical barrier panel sections. Therefore, any decrease in the amount of pre-assembly of the acoustical panel sections that can be carried out in a factory setting will result in significant savings in terms of on-site labour, transportation and relating handling charges.

The second problem area with known acoustical barrier panel systems concerns traffic accidents where vehicles impact with the safety barriers and the cooperating acoustical sound barrier panels. It is common for the acoustical barrier panels to be broken during such impact, and subsequently fall in whole or in part from the "H" beam support frame in which they were retained. Such displaced panels, or portions thereof, may fall onto either the roadway or by the shoulder of the roadway. Where the displaced panels fall onto an unused shoulder of the roadway, this is generally not a serious problem, as no harm would normally be done. However, if the acoustical barrier panels are installed, for example, on a bridge or overpass, or immediately beside a parking lot, playground, residential building, or any other area frequented by persons, serious personal injury to those not otherwise involved in a vehicle accident might occur. Accordingly, it has generally been seen as undesirable to have acoustical barrier panels of the general type described installed on bridges, overpasses etc. Further, small fragments of the composite material of the barrier panel might become separated off the barrier panels under the forceful impact of a vehicle, so as to become projectiles.

Therefore, from the safety standpoint, what is needed is an acoustical barrier panel that precludes portions thereof from being dislodged from the initial retained, assembled configuration in the event of an impact by a vehicle.

What is also needed is an improved acoustical barrier system wherein the panels comprising a section of the system do not need to be put in place in situ, one panel at a time.

It is an object of the present invention to provide an acoustical barrier panel system having a plurality of acoustical barrier panels that are adapted to be installed in place between upright frame members to form a section to the acoustical barrier panel system in a single construction operation.

It is another object of the present invention to provide an acoustical barrier panel system that is adapted for pre-assembly of acoustical barrier panels into one complete acoustical barrier panel section in a factory environment, and subsequent installation of the entire acoustical barrier panel section on-site.

It is yet another object of the present invention to provide an acoustical barrier panel system having improved safety characteristics.

It is a further object of the present invention to provide an acoustical barrier panel system having acoustical barrier panels that are adapted to be held substantially in place by the upright frame members of the system in the event that the acoustical barrier panels are damaged through impact with a vehicle or other moving object.

It is yet a further object of the present invention to provide an acoustical barrier panel system having acoustical barrier panels that are adapted to preclude any substantial fragments of panel material from becoming separated from the panels by reason of an impact with a vehicle.

SUMMARY OF THE INVENTION

In accordance with one aspect of the present invention, there is disclosed a first embodiment of an acoustical barrier wall system for use as an external wall acoustical attenuator for sound sources. The acoustical barrier wall system comprises a plurality of acoustical barrier panels adapted for vertically stacked co-operating engagement. Each of the acoustical barrier panels comprises a main body portion, a top edge, a bottom edge, a first side edge, a second side edge, a first face oriented inwardly toward the sound sources, and a second face oriented outwardly away from the sound sources. There are first and second attachment members, each having a first end anchored within the main body portion and an opposite second end, extending outwardly beyond the main body portion. The first attachment member is disposed adjacent the first side edge of the main body portion and the second attachment member is disposed adjacent the second side edge of the main body portion. There are first and second upright bracing members each having a corresponding plurality of attachment member receiving means spaced therealong. The attachment member receiving means are adapted to receive the respective first and second attachment members of the plurality of vertically stacked acoustical barrier panels. There are connecting means adapted to connect the attachment members and the attachment member receiving means in secured relation to one another. The plurality of vertically stacked acoustical barrier panels are secured together by the attachment members, the first and second upright bracing members, and the connecting means to thereby form a wall section for unitary placement between a pair of spaced upright frame members that are adapted to supportingly receive the plurality of acoustical barrier panels in vertically stacked co-operative engagement therebetween.

In accordance with another aspect of the present invention, there is disclosed a second embodiment of an acoustical barrier wall system for use as an external wall acoustical attenuator for sound sources. The acoustical barrier wall system comprises a plurality of acoustical barrier panels adapted for vertically stacked co-operating engagement with one another between a pair of upright frame members to form a wall section, each of the acoustical barrier panels comprising a main body portion, a top edge, a bottom edge, a first side edge, a second side edge, a first face oriented inwardly toward the sound sources, and a second face oriented outwardly away from the sound sources. There are fastening means adapted to securely fasten the first and second side edges of each acoustical barrier panel forming the wall section to the juxtaposed respective one of the pair of spaced upright frame members. A first reinforcing grid is securely retained within the main body portion of each acoustical barrier panel, wherein a first external portion of the first reinforcing grid extends outwardly from the first side edge of the main body portion of each acoustical barrier panel and a second external portion of the first reinforcing grid extends outwardly from the second side edge of the main body portion of each acoustical barrier panel. The first and second external portions of the first reinforcing grids are thereby adapted for respective, secure, anchored attachment to the juxtaposed one of the pair of spaced upright frame members when the wall section is in place between the pair of spaced upright frame members.

In accordance with yet another aspect of the present invention, there is disclosed a third embodiment of an acoustical barrier wall system for use as an external wall acoustical attenuator for sound sources. The acoustical barrier wall system comprises a plurality of acoustical barrier panels adapted for vertically stacked co-operating engagement with one another between a pair of upright frame members to form a wall section, each of the acoustical barrier panels comprising a main body portion, a top edge, a bottom edge, a first side edge, a second side edge, a first face oriented inwardly toward the sound sources, and a second face oriented outwardly away from the sound sources. There is fastening means adapted to securely fasten the first and second side edges of each acoustical barrier panel forming the wall section to the juxtaposed respective one of the pair of spaced upright frame members. The outwardly facing second faces of the plurality of vertically stacked acoustical barrier panels together form a second face of the wall section, which second face is substantially overlain by a generally planar retaining member. The retaining member is securely fastened to each of the pair of spaced upright frame members adjacent its two its lateral edges so as to be adapted to retain the main body portion of the plurality of vertically stacked acoustical barrier panels, or fragments thereof, generally within the confines of the pair of upright frame members in the event that one or more of the inwardly facing first faces of the acoustical barrier panels constituting the wall section are impacted against.

Other advantages, features and characteristics of the present invention, as well as methods of operation and functions of the related elements of the structure, and the combination of parts and economies of manufacture, will become more apparent upon consideration of the following detailed description and the appended claims with reference to the accompanying drawings, the latter of which is briefly described hereinbelow.

DETAILED DESCRIPTION OF A PREFERRED EMBODIMENT

Figure 1:
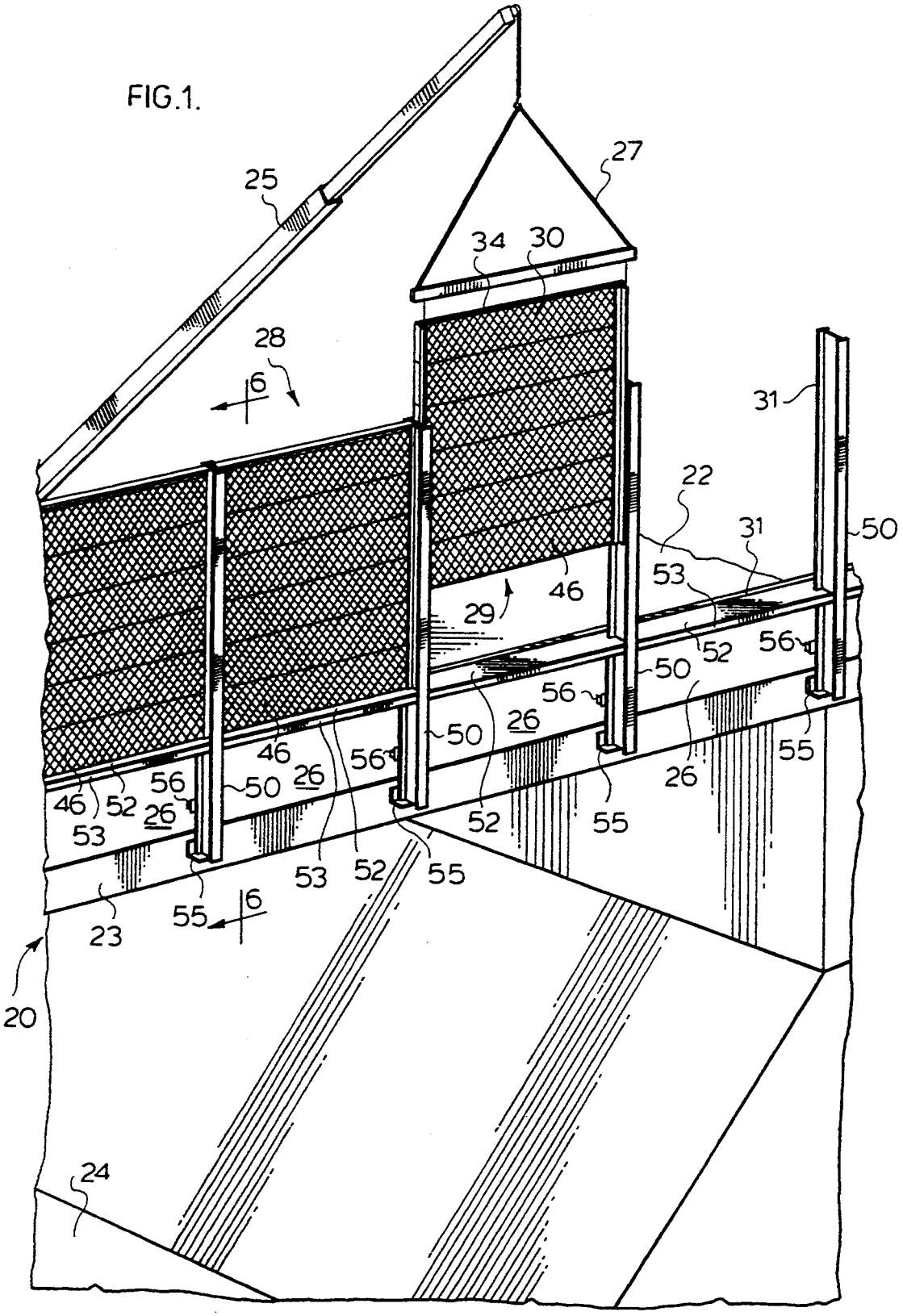
FIG. 1 is a perspective view of an overpass having one section of the acoustical barrier panel system of the present invention being installed by a crane, with two other sections of the acoustical barrier panel system already installed.
Figure 2:
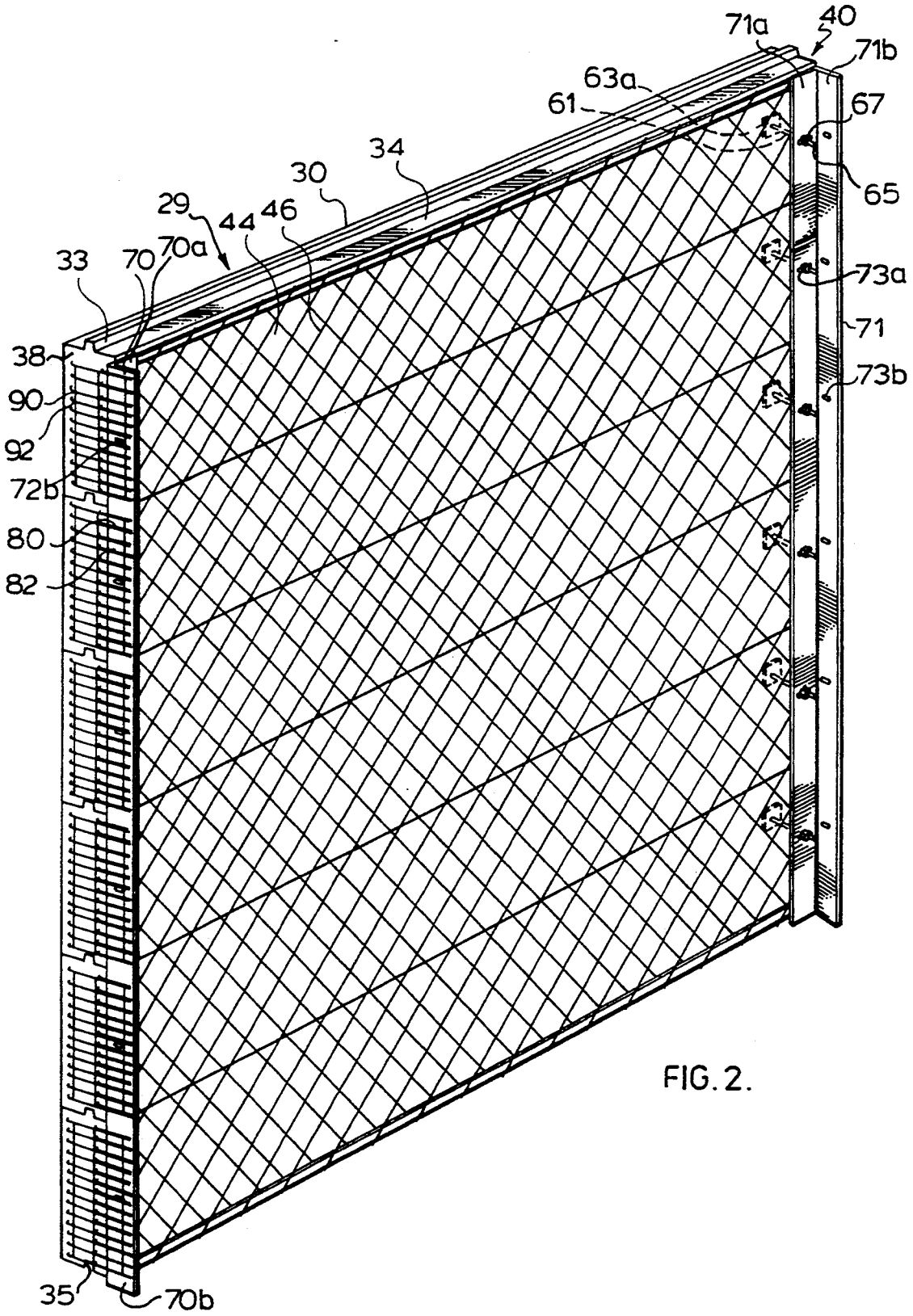
FIG. 2 is a perspective view of a single section of the acoustical barrier panel system according to the preferred embodiment of the present invention, comprising six acoustical barrier panels.
Figure 6:
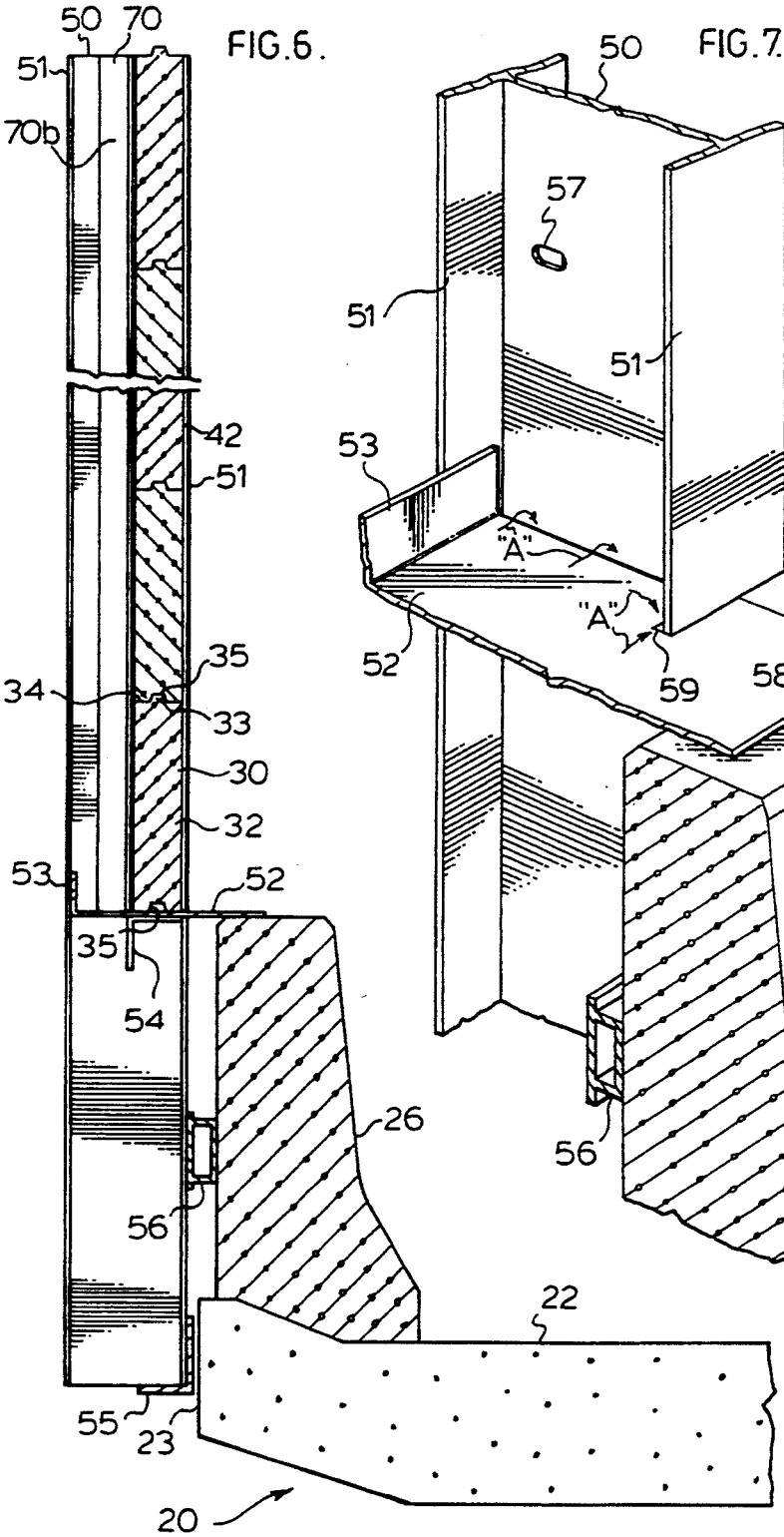
FIG. 6 is a cross-sectional side view taken along section lines 6—6 of FIG. 1; and, FIG. 7 is an enlarged perspective view of the bottom portion of an upright frame member and a juxtaposed safety barrier (as seen in FIGS. 1 and 6) upon which acoustical barrier panel system is installed, prior to placing the acoustical barrier panel system sections of the present invention in place.

Reference will now be made to FIG. 1, which shows a roadway overpass, as designated by the general reference numeral 20, wherein a first roadway 22 crosses over a second roadway 24. The first roadway 22 has a series of concrete safety barriers 26, Which are commonly referred to in the industry as "New Jersey" or "Jersey" type barriers. As can be seen in FIG. 6, these barriers are located along the side of the first roadway 22 at the edge thereof and are, in the case of use on an overpass, as shown, Typically anchored in place on the overpass, by conventional anchoring means (not shown). The sectional acoustical barrier wall system of the present invention, which is designated by general reference numeral 28, is fastened to the edge 23 of the roadway 22 and to the safety barriers 26 by way of a suitable framework, which is indicated by general reference numeral 31, which will be described in greater detail subsequently.

A crane 25 is shown lowering one wall section, as indicated by general reference numeral 29, of the sectional acoustical barrier wall system 28, which comprises six stacked acoustical barrier panels 30, into the framework 31. A rigging 27, is being used to properly balance and support the load of the wall section 29 (of the sectional acoustical barrier wall system 28) being installed.

Figure 7:
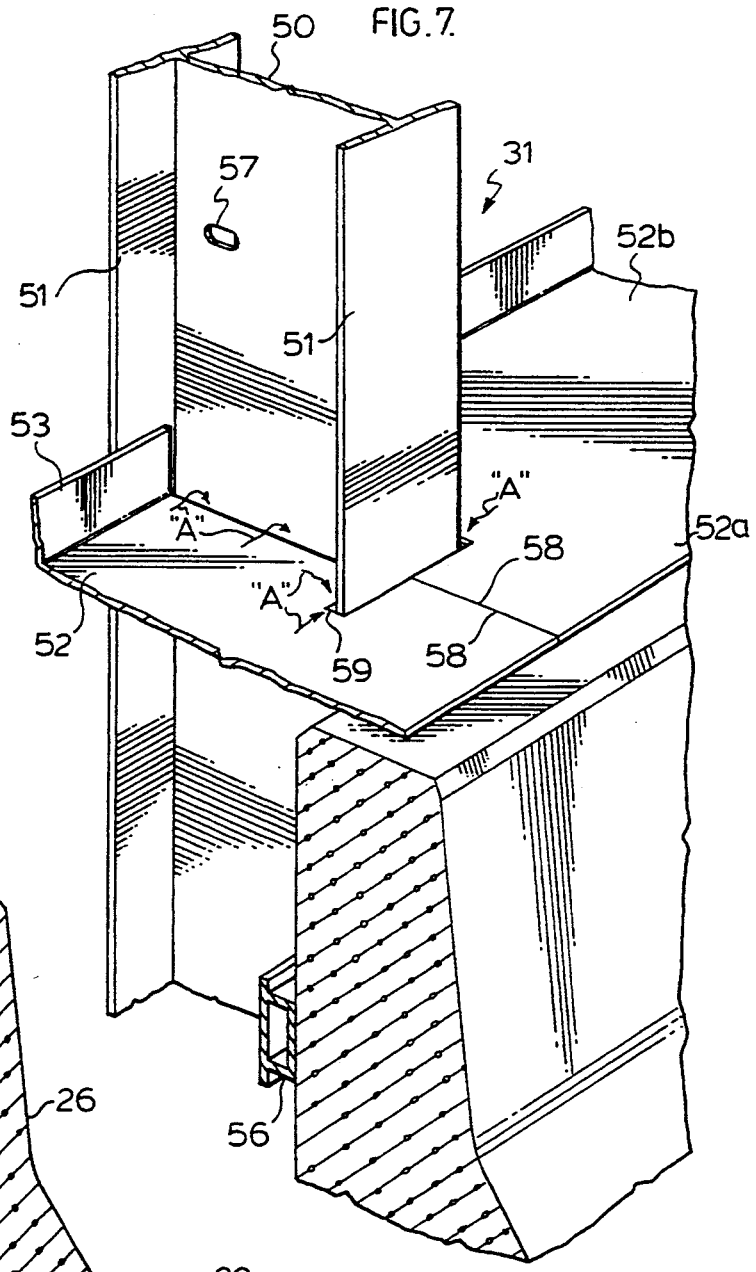

As can be seen in FIGS. 1, 6 and 7, the framework 31 comprises a plurality of spaced upright frame members 50, which are preferably "H" shaped in cross section, and have a plurality of oblong apertures 57 positioned in the central web portion 50*a* thereof, and disposed along the length of the central web portion 50*a*. These spaced upright frame members 50 are each preferably attached to the concrete bed of the first roadway 22 by support members 55. The support members 55 are preferably attached to the concrete bed of the roadway 22 by known fastening means, such as bolts or similar threaded fastening members extending outwardly from the edge 23 of the first roadway 22. The spaced upright frame members 50 are bolted and/or welded to the support member 55. The spaced upright frame members 50 are attached to the safety barriers 26 by way of spacer members 56, which spacer members 56 are attached to the safety barriers 26 by known fastening means, such as bolts or similar threaded fastening members. The spaced upright frame members 50 are attached to the spacer members 56 by welding or by bolts, or both, as is common in the industry.

Figure 3:
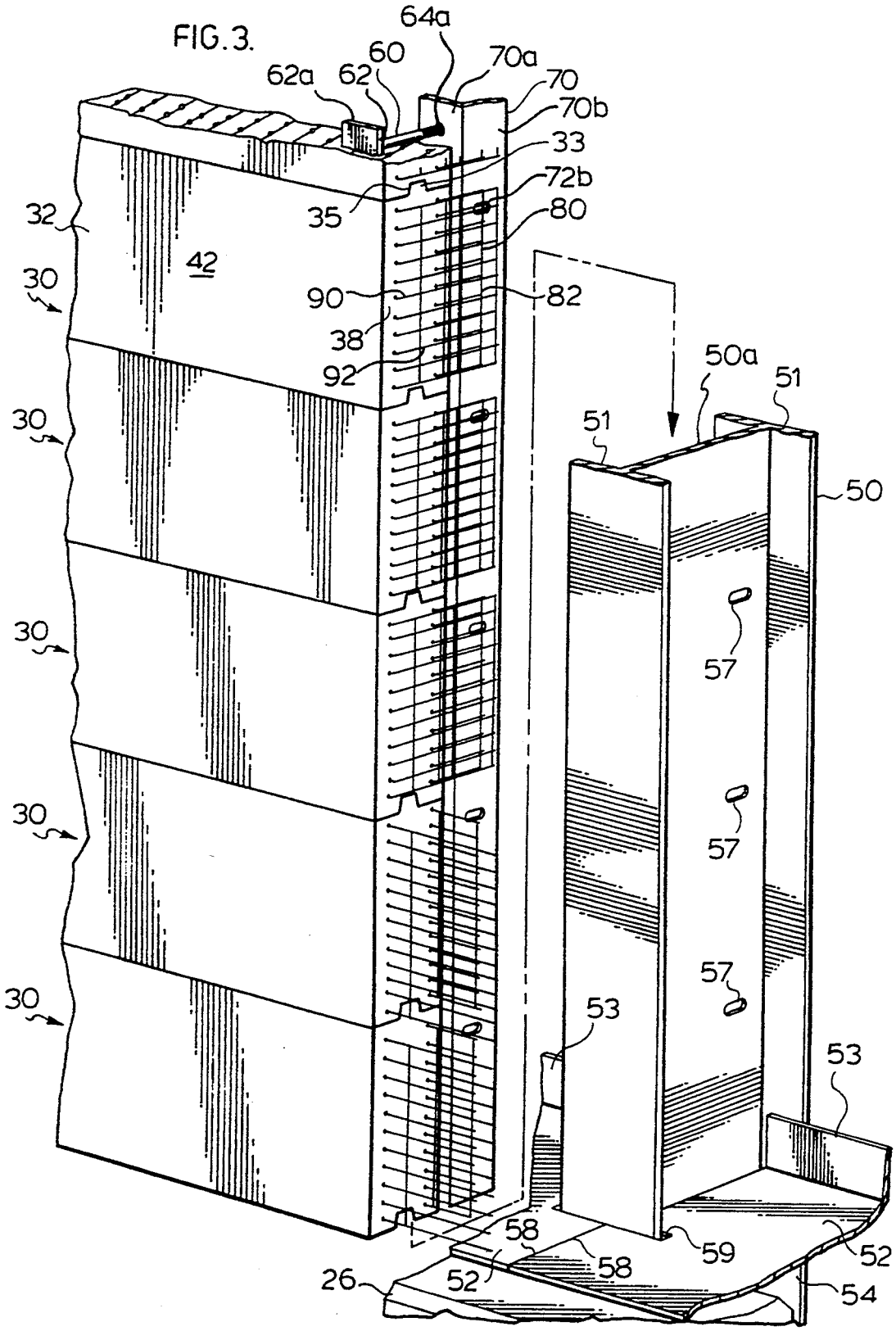
FIG. 3 is an perspective end view of the acoustical barrier panel section of FIG. 2, shown in conjunction with an upright frame member.
Figure 4:
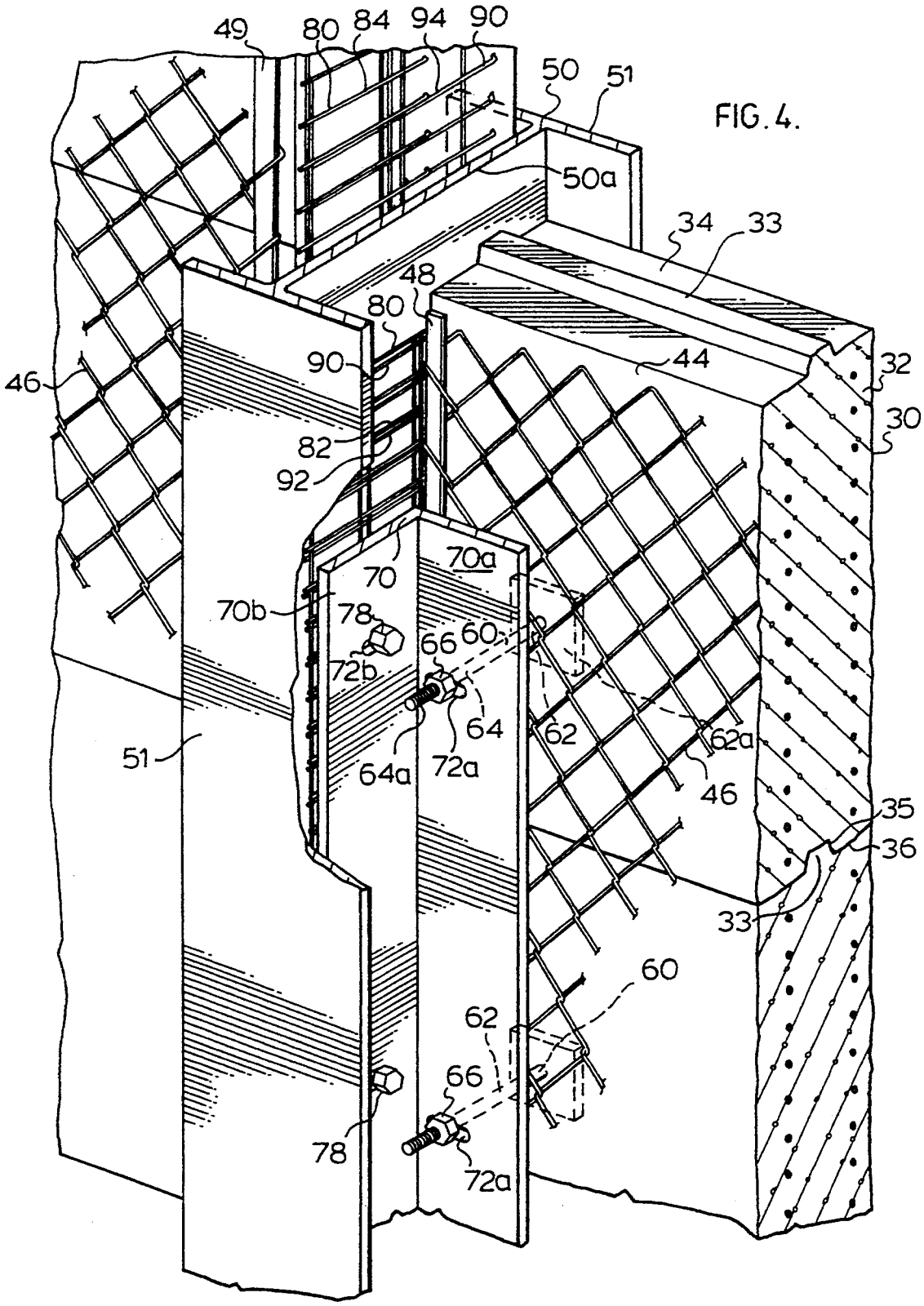
FIG. 4 is an enlarged perspective view of a top corner portion of one section of the acoustical barrier panel system of FIG. 1, installed and secured in place at an upright frame member, a portion of which frame member is cut-away for ease of illustration.

Located between each pair of spaced upright frame members are base members 52, (see especially FIGS. 3 & 7), which base members 52 are adapted at their ends 58, by way of a slot 59 to receive one of the flange portions 51 of the respective upright frame member 50 therein. Preferably, a small gap is left between the ends of the base members 52 and the respective spaced upright frame members 50 in order to allow for water to drain therethrough, as indicated by arrows "A" in FIG. 7. The front portion 52*a* of each base member 52 rests on top of one safety barrier 26. The back portion 52*b* of each base member 52 includes an upturned flange 53, with the end portions of the upturned flange 53 being welded to the appropriate flange portion of the respective upright frame member 50. Each base member 52 provides a platform for placement of the respective wall section of the sectional acoustical barrier wall system 28.

Reference will now be made to FIGS. 2 through 5, which show in greater detail the acoustical barrier panels 30, which are adapted for vertically stacked cooperating engagement at the side of the first roadway 22. The acoustical barrier panels 30 each comprise a main body portion 32, a top edge 34 with a raised key 33 disposed therealong, a bottom edge 36 with a cooperating recessed slot 35 therealong, a first side edge 38, a second side edge 40, an inwardly facing first face 42, and an outwardly facing second face 44. The main body portion 32 of the acoustical barrier panel 30 is formed from a layer of concrete and a layer of chemically mineralized and neutralized fibres blended with portland cement, as generally disclosed in previously referenced U.S. Pat. No. 4,325,457. In order that the acoustical barrier panels 30 stack properly one on top of the other, and also to preclude the barrier panels from shifting laterally with respect to one another, the raised key 33 in the top edge 34 thereof is adapted to mate in close fitting relation into the cooperating recessed slot 35 in the bottom edge 36.

Each acoustical barrier panel 30 has a first attachment member 60 and a second attachment member 61 (see FIG. 5) securely retained within the main body portion 32 thereof. The first 60 and second 61 attachment members have respective first ends 62, 63, each of which first 62 and second 63 first ends is anchored within the main body portion 32. Each of the first 62 and second 63 first ends terminates in a square or rectangular head portion 62*a*, 63*a* respectively. The head portions 62*a*, 63*a* preclude the respective of the first 60 and second 61 attachment members from being pulled out of the acoustical barrier panel 30. Opposite respective second ends 64, 65 extend outwardly beyond the main body portion 32, preferably from the inwardly facing first face 42. The second ends 64, 65 terminate in threaded shaft portions 64*a*, 65*a* respectively. The first attachment member 60 is disposed adjacent the first side edge 38 of the main body portion 32, and the second attachment member 61 is disposed adjacent the second side edge 40 of the main body portion 32 (see FIG. 5).

In order to form a complete wall section, such as wall section 29 (of FIG. 1), a plurality, usually from four to eight, of acoustical barriers panels are first stacked in place one on top of another, and are ultimately secured in place by first 70 and second 71 cooperating upright bracing members (see FIG. 5), which cooperating upright bracing members 70, 71 are each in the form of an elongated metal angle iron and are located one at each end of the wall section 29. The structure and function of the first upright bracing member 70 are identical to the structure and function of the second upright bracing member 71, and therefore the following explanation of the structure and function of the first 70 and second 71 upright bracing members will generally only refer to the first upright bracing member 70, but the explanation applies equally to the second upright bracing member 71. The first 70 upright bracing member is preferably "L"-shaped in cross-section (as shown), having a first flange portion 70*a* and a second flange portion 70*b*. The first flange portion 70*a* has a plurality of attachment member receiving means in the form of oblong apertures 72*a* therein, generally regularly spaced along the length thereof. The second flange portion 70*b* has a corresponding plurality of oblong apertures 72*b* therein also generally regularly spaced therealong. The oblong apertures 72*a* in the first flange portion 70*a* are adapted to receive the threaded shaft portion 64*a* of the respective first attachment members 60 therethrough. The oblong apertures 72*a* are oblong so as to facilitate easy register with the first attachment members 60.

The first upright bracing member 70 is held in place on the wall section 29 by connecting means in the form of suitably threaded cooperating nuts 66 engaged on the threaded shaft portion 64*a* of each of the first attachment members 60.

The oblong apertures 72*b* in the second flange portion 70*b* are adapted to receive any known mounting means, such as bolts, therethrough, and are also oblong so as to facilitate easy register with the cooperating apertures 57 in the spaced upright frame members 50. The apertures 72*a* in the first flange portion 70*a* are preferably offset along the vertical length thereof with respect to the apertures 72*b* in the second flange portion 70*b*, so as to allow for easier non-conflicting access to the fastening means placed therein.

In the manner described above, the vertically stacked barrier panels 30 are secured together by the first 60 and second 61 attachment members, the first 70 and second 71 upright bracing members, and the connecting means in the form of cooperating nuts 66, 67 to form the complete wall section 29. The complete wall section 29 of vertically stacked acoustical barrier panels 30 is thereby adapted for unitary placement between two adjacent upright frame members that are adapted to supportingly receive the complete wall section 29 so as to be securely retained thereby in vertically stacked cooperative engagement therebetween, as will be discussed subsequently in greater detail.

The outwardly facing second faces 44 of the plurality of vertically stacked acoustical barrier panels 30 together form a second face of the wall section 29. The second face of the wall section 29 is overlain by a generally planar retaining member in the form of a screen member 46, which screen member 46 may also take other forms, such as a metal plate or the like, and still perform its intended task properly. The screen member 46 is secured in trapped relation between the outwardly facing second face 44 and a first surface 74 (see FIG. 5) of the first upright bracing member 70 and the first surface 75 of the second upright bracing member 71. A pair of flat metal bars 48, 49 are interwoven at respective ends of each barrier panel 30 into the openings in the screen member 46, so as to assist in anchoring the screen member 46. The metal bars 48, 49 are also secured in trapped relation between the outwardly facing second face 44 and the first surfaces 74, 75 of the respective of the first 70 and second 71 upright bracing members. The cooperating nuts 66, 67 on the respective of the first 60 and second 61 attachment members are tightened until the screen member 46 is secured in place in relatively unmoving relation against the outwardly facing second face 44 of the acoustical barrier panels 30. The retaining member in the form of the screen member 46 is adapted to retain the main body portion 32 of each of the plurality of vertically stacked acoustical barrier panels 30, or fragments thereof, generally within the confines of the upright frame members 50 in the event that any of the acoustical barrier panels 30 is impacted against. Such impact would typically be caused by a vehicle on the first roadway 22 impacting against the inwardly facing first faces 42 of the acoustical barrier panels 30. Such retainment would prevent serious injury to users of the second roadway passing below the first roadway 22.

One significant advantage of the sectional acoustical barrier wall system 28 of the present invention is that of pre-construction of individual wall sections 29 of the acoustical barrier wall system 28 in a factory setting, as opposed to the standard practice of assembling each wall section in situ from individual acoustical barrier panels on a construction site. In an appropriately equipped factory setting, the wall sections 29 of the acoustical barrier wall system 28 can be more efficiently, more quickly, and more accurately assembled, especially if automation techniques are employed. In order to assemble a single wall section 29 of the acoustical barrier wall system 28, the acoustical barrier panels 30 are vertically stacked on one top of another, the screen member 46 put in place against the outwardly facing second faces 44 of the acoustical barrier panels 30, with the first 60 and second 61 attachment members of each of the acoustical barrier panels protruding through openings in the screen member 46. The first 70 and second 71 upright bracing members are then put in place against the vertically stacked barrier panels 30 such that the oblong apertures 72*a* in the first flange portion 70*a* of the first upright bracing member 70 receive the first 60 attachment members therein, and the oblong apertures 73*a* in the first flange portion 71*a* of the second upright bracing member 71 receive the second 61 attachment members therein. The first 70 and second 71 upright bracing members are secured in place thereat by cooperating nuts 66,67.

A further advantage of the sectional acoustical barrier wall system of the present invention is that the acoustical barrier panels 30 can be shipped as completed wall sections, which allows more of them to be carried on a single flatbed truck trailer, which in turn allows fewer trucks to be used, thereby reducing shipping costs. Further, it is much less time consuming to install the acoustical barrier panels 30 by complete wall section 29, as shown in FIG. 1, than one barrier panel 30 at a time, as is done with prior art systems. This allows for significant cost savings in that the delivery truck and the installing crane are not needed for as long a period of time.

After the wall sections 29 of acoustical barrier panels 30 have been set in place between adjacent spaced upright frame members 50, they are secured in place by bolts 78, which fit through the oblong apertures **72*b* in the second flange portion 70*b* of the first upright bracing member 70 and through the oblong apertures 57 in the appropriate upright frame member 50. Similarly, bolts (not shown) which fit through oblong apertures 73*b* in the second flange portion 71*b* of the second upright bracing member 71 and through the oblong apertures 57 in the appropriate upright frame member 50. Again, the apertures are oblong so as to facilitate easy register with the cooperating apertures 57 in the spaced upright frame members 50. The bolts 78 in the first upright bracing member 70 are secured by cooperating nuts 79. The bolts (not shown) in the second upright bracing member 71** are also similarly secured by cooperating nuts (not shown).

In the preferred embodiment illustrated, the acoustical barrier panels 30 each further comprise a first reinforcing grid 80 and a second reinforcing grid 90 securely retained within the main body portion 32 of the acoustical barrier panels in spaced apart generally parallel relation to each other. The first re-enforcing grid 80 is disposed toward the outwardly facing second face 44 of the main body portion 32 in generally parallel relation thereto and the second re-enforcing grid 90 is disposed toward the inwardly facing first face 42 of the main body portion 32 in generally parallel relation thereto. A first external portion 82 of the first reinforcing grid 80 extends outwardly from the first side edge 38 of the main body portion 32 of the acoustical barrier panel 30, and is thereby adapted for secure anchored attachment to the juxtaposed one of the spaced upright frame members 50 when the wall section 29 is in place between the pair of upright frame members 50. Similarly, a second external portion 84 of the first reinforcing grid 80 extends outwardly from the second side edge 40 of the main body portion 32 of the acoustical barrier panel 30, and is thereby adapted for secure anchored attachment to the juxtaposed one of the spaced upright frame members 50 when the wall section 29 is in place between the pair of upright frame members 50. Further, a first external portion 92 of the second reinforcing grid 90 extends outwardly from the first side edge of the main body portion 32 of the acoustical barrier panels 30 and a second external portion 94 of the second reinforcing grid 90 extends outwardly from the second side edge 40 of the main body portion 32 of the acoustical barrier panels 30. The first 92 and second 94 external portions of the second reinforcing grid 90 are each adapted for secure anchored attachment to the respective juxtaposed ones of the spaced upright frame members 50, when the wall section 29 is in place between the pair of upright frame members 50.

Figure 5:
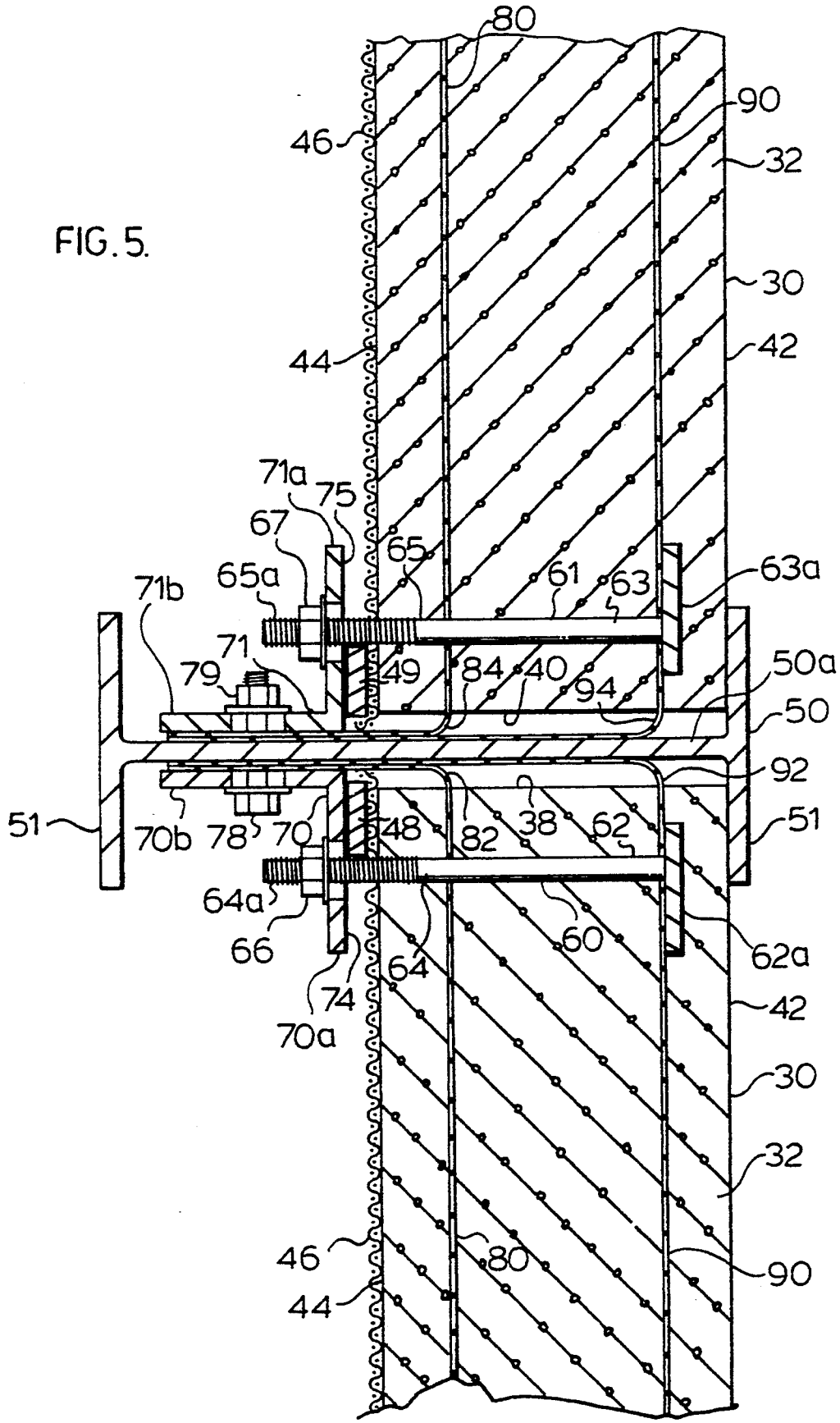
FIG. 5 is a sectional view from the top of juxtaposed end portions of two acoustical barrier panel sections, each in place in an upright frame member.

As can be best seen in FIG. 5, the first 82 and second 84 external portions of the first reinforcing grid 80 and the first 92 and second 94 external portions of the second reinforcing grid 90 are trapped between the second flange portions **70*b*, 71*b* of the respective first 70 and second 71 upright bracing members and the central portion 50*a* of the spaced upright frame member 50. The bolts 78 preferably pass through appropriate openings in the first 80 and second 90 reinforcing grids, so as to attach in secure, anchored relation, each of the respective acoustical barrier panels 30 to the upright frame members 50, to thereby keep the acoustical barrier panels 50 anchored to the upright frame members 50 in the event that the main body portion 32 of the acoustical barrier panels 30 is unwontedly removed from between two adjacent upright frame members 50, such as might occur during a collision by a vehicle with the sectional acoustical barrier wall system 28. The first 80 and second 90 and reinforcing grids are preferably made of a suitable plastic material, and are moulded into the main body portion 32 of each of the acoustical barrier panels 30 during construction of the acoustical barrier panels 30**.

If the acoustical barrier panels 30 are impacted by a vehicle so as to dislodge the main body portion 32 from between adjacent space upright frame members 50, the first 80 and second 90 reinforcing grids will substantially preclude the main body portion 32 of the acoustical barrier panels 30 from falling from the first roadway 22 down onto the second roadway 24 or whatever is beneath the first roadway 22. Any relatively small portions of the material that comprise the main body portion 32 of the acoustical barrier panels 30 that might break away from the main body portion 32 in spite of the aforesaid anchoring of the first 80 and second 90 reinforcing grids are further retained by the screen member 46 at the outwardly facing second face 44 of the main body portion 32 which thereby acts as a retaining member. Any such portions broken away from the main body portion 32 which are able to fit through the openings in the screen member 46 are sufficiently small so as not to be a serious hazard to those using the second roadway 24.

While only one specific embodiment has been illustrated and described, numerous modifications come to mind without significantly departing from the spirit of the invention and the scope of protection is only limited by the scope of the accompanying claims.

We claim:

1. An acoustical barrier wall system for use as an external wall acoustical attenuator for sound sources, comprising:

a plurality of acoustical barrier panels adapted for vertically stacked co-operating engagement, each of said acoustical barrier panels comprising a main body portion, a top edge, a bottom edge, a first side edge, a second side edge, a first face oriented inwardly toward said sound sources, and a second face oriented outwardly away from said sound sources;

first and second attachment members each having a first end anchored within said main body portion and an opposite second end extending outwardly beyond said main body portion, said first attachment member being disposed adjacent said first side edge of said main body portion and said second attachment member being disposed adjacent said second side edge of said main body portion;

first and second upright bracing members each having a corresponding plurality of attachment member receiving means spaced therealong, said attachment member receiving means being adapted to receive the respective first and second attachment members of said plurality of vertically stacked acoustical barrier panels;

connecting means adapted to connect said attachment members and said attachment member receiving means in secured relation to one another;

wherein said plurality of vertically stacked acoustical barrier panels are secured together by said attachment members, said first and second upright bracing members, and said connecting means to thereby form a wall section for unitary placement between a pair of spaced upright frame members adapted to supportingly receive said plurality of acoustical barrier panels in vertically stacked co-operative engagement therebetween.

2. The acoustical barrier system of claim 1, wherein said first and second upright bracing members are adapted for secure fastening to the respective one of said pair of spaced upright frame members following said unitary placement of said wall section.

3. The acoustical barrier system of claim 2, further comprising a first reinforcing grid securely retained within said main body portion of each acoustical barrier panel, wherein a first external portion of said first reinforcing grid extends outwardly from said first side edge of said main body portion of each acoustical barrier panel and a second external portion of said first reinforcing grid extends outwardly from said second side edge of said main body portion of each acoustical barrier panel, with said first and second external portions of said first reinforcing grids thereby being adapted for respective, secure, anchored attachment to a juxtaposed one of said pair of spaced upright frame members when the wall section is in place between said pair of spaced upright frame members.

4. The acoustical barrier system of claim 3, further comprising a second reinforcing grid securely retained within said main body portion of each acoustical barrier panel, wherein a first external portion of said second reinforcing grid extends outwardly from said first side edge of said main body portion of each acoustical barrier panel and a second external portion of said second reinforcing grid extends outwardly from said second side edge of said main body portion of each acoustical barrier panel, with said first and second external portions of said second reinforcing grids thereby being adapted for secure, anchored attachment to a juxtaposed one of said spaced upright frame members when the wall section is in place between said pair of spaced upright frame members.

5. The acoustical barrier system of claim 4, wherein said first and second reinforcing grids are positioned within the main body portion in spaced apart generally parallel relation to each other.

6. The acoustical barrier system of claim 1, wherein said first and second attachment members each have their first end portions anchored within the main body portion by means of a head portion, and each have their second end portions being threaded end portions extending outwardly beyond said main body portion; wherein said attachment member receiving means comprises a portion of each of said upright bracing members including an aperture therein, said aperture being adapted to receive said threaded portion of the respective one of said attachment members therein; and, wherein said connecting means comprises nut means adapted for cooperative engagement with said threaded end portions of said first and second attachment members.

7. The acoustical barrier system of claim 6, wherein said apertures are regularly spaced along said first and second upright bracing members.

8. The acoustical barrier system of claim 7, wherein said apertures in said upright bracing member are oblong.

9. The acoustical barrier system of claim 8, wherein said first and second upright bracing members each comprises an elongated metal bar.

10. The acoustical barrier system of claim 9, wherein said upright bracing members are "L" shaped in cross-section, and are thereby in the form of an elongated metal angle iron.

11. The acoustical barrier system of claim 10, wherein said attachment members extend outwardly from said main body portion in generally perpendicular relation through said second face.

12. The acoustical barrier system of claim 11, wherein said main body portion has a raised key disposed along said top edge and a cooperating recessed slot along said bottom edge.

13. The acoustical barrier system of claim 2, wherein the outwardly facing second faces of said plurality of vertically stacked acoustical barrier panels together form a second face of said wall section, which second face is substantially overlain by a generally planar retaining member, said retaining member being secured in trapped relation between said second face of said wall section and said first and second upright bracing members, said retaining member thereby being adapted to retain the main body portion of each of said plurality of vertically stacked acoustical barrier panels, or fragments thereof, generally within the confines of said pair of upright frame members in the event that one or more of the inwardly facing first faces of said acoustical barrier panels constituting said wall section are impacted against.

14. The acoustical barrier system of claim 3, wherein said first reinforcing grid is constructed of plastics material.

15. The acoustical barrier system of claim 1, wherein said acoustical barrier panels are formed substantially from a layer of fine aggregate concrete and a layer of chemically mineralized and neutralized fibres blended with portland cement.

16. The acoustical barrier system of claim 1, wherein said acoustical barrier panels are adapted for use in conjunction with preformed concrete roadway safety barriers.

17. The acoustical barrier system of claim 1, wherein said spaced upright frame members are "H" shaped in cross-section.

18. An acoustical barrier wall system for use as an external wall acoustical attenuator for sound sources, comprising:

a plurality of acoustical barrier panels adapted for vertically stacked co-operating engagement with one another between a pair of upright frame members to form a wall section, each of said acoustical barrier panels comprising a main body portion, a top edge, a bottom edge, a first side edge, a second side edge, a first face oriented inwardly toward said sound sources, and a second face oriented outwardly away from said sound sources;

fastening means adapted to securely fasten said first and second side edges of each acoustical barrier panel forming said wall section to the juxtaposed respective one of said pair of spaced upright frame members; and, a first reinforcing grid securely retained within said main body portion of each acoustical barrier panel, wherein a first external portion of said first reinforcing grid extends outwardly from said first side edge of said main body portion of each acoustical barrier panel and a second external portion of said first reinforcing grid extends outwardly from said second side edge of said main body portion of each acoustical barrier panel, with said first and second external portions of said first reinforcing grids thereby being adapted for respective, secure, anchored attachment to said juxtaposed one of said pair of spaced upright frame members when the wall section is in place between said pair of spaced upright frame members.

19. The acoustical barrier system of claim 18, further comprising a second reinforcing grid securely retained within said main body portion of each acoustical barrier panel, wherein a first external portion of said second reinforcing grid extends outwardly from said first side edge of said main body portion of each acoustical barrier panel and a second external portion of said second reinforcing grid extends outwardly from said second side edge of said main body portion of each acoustical barrier panel, with said first and second external portions of said second reinforcing grids thereby being adapted for secure, anchored attachment to said juxtaposed one of said spaced upright frame members when the wall section is in place between said pair of spaced upright frame members.

20. The acoustical barrier system of claim 19, wherein said first and second reinforcing grids are in spaced apart generally parallel relation to each other.

21. The acoustical barrier system of claim 20, wherein said main body portion has a raised key disposed along said top edge and a cooperating recessed slot along said bottom edge.

22. The acoustical barrier system of claim 19, wherein said first reinforcing grid is constructed of plastics material.

23. The acoustical barrier system of claim 18, wherein said acoustical barrier panels are formed substantially from a layer of fine aggregate concrete and a layer of chemically mineralized and neutralized fibres blended with portland cement.

24. The acoustical barrier system of claim 18, wherein said acoustical barrier panels are adapted for use in conjunction with preformed concrete roadway safety barriers.

25. The acoustical barrier system of claim 18, wherein said spaced upright frame members are "H" shaped in cross-section.

26. An acoustical barrier wall system for use as an external wall acoustical attenuator for sound sources, comprising:

a plurality of acoustical barrier panels adapted for vertically stacked co-operating engagement with one another between a pair of upright frame members to form a wall section, each of said acoustical barrier panels comprising a main body portion, a top edge, a bottom edge, a first side edge, a second side edge, a first face oriented inwardly toward said sound sources, and a second face oriented outwardly away from said sound sources;

fastening means adapted to securely fasten said first and second side edges of each acoustical barrier panel forming said wall section to the juxtaposed respective one of said pair of spaced upright frame members; and, wherein the outwardly facing second faces of said plurality of vertically stacked acoustical barrier panels together form a second face of said wall section, which second face is substantially overlain by a generally planar retaining member, said retaining member being securely fastened to each of said pair of spaced upright frame members adjacent its two its lateral edges so as to be adapted to retain the main body portion of said plurality of vertically stacked acoustical barrier panels, or fragments thereof, generally within the confines of said pair of upright frame members in the event that one or more of the inwardly facing first faces of said acoustical barrier panels constituting said wall section are impacted against.

27. The acoustical barrier system of claim 26, wherein said generally planer retainer member is securely fastened to each of said pair of spaced upright frame members as aforesaid by said fastening means.

28. The acoustical barrier system of claim 26, wherein said main body portion has a raised key disposed along said top edge and a cooperating recessed slot along said bottom edge.

29. The acoustical barrier system of claim 26, wherein said acoustical barrier panels are formed substantially from a layer of fine aggregate concrete and a layer of chemically mineralized and neutralized fibres blended with portland cement.

30. The acoustical barrier system of claim 26, wherein said acoustical barrier panels are adapted for use in conjunction with preformed concrete roadway safety barriers.

31. The acoustical barrier system of claim 26, wherein said spaced upright frame members are "H" shaped in cross-section.

* * * * *